US009857143B2

(12) United States Patent
Teetzel et al.

(10) Patent No.: US 9,857,143 B2
(45) Date of Patent: Jan. 2, 2018

(54) MODULAR SIGHTING ASSEMBLY AND METHOD

(71) Applicant: WILCOX INDUSTRIES CORP., Newington, NH (US)

(72) Inventors: James W. Teetzel, Portsmouth, NH (US); Gary M. Lemire, Lee, NH (US); Marvin S. Carter, III, Rochester, NH (US); Daryl Francis, South Berwick, ME (US); Dean B. Killam, Atkinson, NH (US); Jansen Habrial, Brookfield, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 15/334,396

(22) Filed: Oct. 26, 2016

(65) Prior Publication Data

US 2017/0299330 A1 Oct. 19, 2017

Related U.S. Application Data

(63) Continuation of application No. 14/635,177, filed on Mar. 2, 2015, now Pat. No. 9,506,723.

(60) Provisional application No. 61/947,199, filed on Mar. 3, 2014.

(51) Int. Cl.

| | |
|---|---|
| ***F41G 1/473*** | (2006.01) |
| ***F41G 3/06*** | (2006.01) |
| ***G06G 7/80*** | (2006.01) |
| ***F41G 1/35*** | (2006.01) |

(52) U.S. Cl.

CPC ..... *F41G 1/35* (2013.01); *F41G 1/473* (2013.01); *F41G 3/065* (2013.01)

(58) Field of Classification Search

CPC ..... F41G 1/00; F41G 1/28; F41G 1/16; F41G 1/473; F41G 3/06; G06G 7/80

USPC ..... 89/41.17; 42/114, 115, 117, 142; 235/404, 414, 417

See application file for complete search history.

(56) References Cited

U.S. PATENT DOCUMENTS

| | | | |
|---|---|---|---|
| 4,965,439 | A | 10/1990 | Moore |
| 5,033,219 | A | 7/1991 | Johnson |
| 5,052,801 | A | 10/1991 | Downes |
| 5,359,779 | A | 11/1994 | Polk |
| 5,374,986 | A | 12/1994 | Solinsky |
| 5,555,662 | A | 9/1996 | Teetzel |
| 5,669,174 | A | 9/1997 | Teetzel |

(Continued)

FOREIGN PATENT DOCUMENTS

| | | | |
|---|---|---|---|
| RU | 2536186 | C1 | 12/2014 |
| WO | WO2011022426 | A1 | 2/2011 |

OTHER PUBLICATIONS

UK Search Report dated Jun. 25, 2015 received in GB1503511.6.

*Primary Examiner* — Jonathan C Weber

(74) *Attorney, Agent, or Firm* — McLane Middleton, Professional Association

(57) ABSTRACT

A laser sighting system can be used in combination with a range finder for determining a distance to a target. An onboard ballistics computer processor in the laser sighting system calculates a trajectory and automatically rotates a pointing laser to the proper angle for causing the trajectory path of a fired projectile to intersect with the position of the target. The laser sighting system can also be used in a standalone mode wherein target distance information is input manually by the user.

24 Claims, 11 Drawing Sheets

(56) References Cited

U.S. PATENT DOCUMENTS

| | | | | |
|---|---|---|---|---|
| 8,047,118 | B1 | 11/2011 | Teetzel | |
| 8,100,044 | B1 | 1/2012 | Teetzel et al. | |
| 8,459,822 | B1 | 6/2013 | Lambert | |
| 8,505,434 | B2 | 8/2013 | Wieland | |
| 8,561,518 | B2 | 10/2013 | Teetzel | |
| 8,978,539 | B2 | 3/2015 | Teetzel | |
| 9,506,723 | B2 * | 11/2016 | Teetzel | F41G 1/35 |
| 2009/0178325 | A1 | 7/2009 | Veilleux | |
| 2010/0058640 | A1 | 3/2010 | Moore | |
| 2011/0154712 | A1 | 6/2011 | Moore | |
| 2011/0225867 | A1 | 9/2011 | Moore | |
| 2012/0043381 | A1 | 2/2012 | Teetzel et al. | |
| 2012/0110886 | A1 | 5/2012 | Moore | |
| 2013/0133510 | A1 | 5/2013 | Piazza et al. | |
| 2014/0123531 | A1 | 5/2014 | Hancosky | |
| 2014/0298705 | A1 * | 10/2014 | Hancosky | F41G 1/54 42/113 |

* cited by examiner

MODULAR SIGHTING ASSEMBLY AND METHOD

CROSS-REFERENCE TO RELATED APPLICATIONS

The present application is a continuation of U.S. application Ser. No. 14/635,177 filed Mar. 2, 2015, which claims the benefit of provisional application No. 61/947,199 filed Mar. 3, 2014. Each of the aforementioned applications is incorporated herein by reference in its entirety.

BACKGROUND

The present disclosure relates to a modular sighting assembly for use with a weapon system. The present disclosure will be made herein primarily by way of reference to the preferred embodiment wherein the weapon is a grenade launcher, although it will be recognized that the present development is not limited to use with weapons of any particular type, size, munitions type, or caliber. The grenade launcher is preferably of the type that is attachable to a military or assault rifle such as an M-16 assault rifle, M-4 Carbine, or the like, although use with a standalone grenade launcher is also contemplated. Although, the present development is particularly advantageous for aiming firearms and artillery that launch or fire projectiles at relatively high elevation angles, the present development is not limited to such and can be used with any type of firearm or artillery that launches a projectile with a known trajectory. The terms "firearm" and "artillery" as used herein are intended to encompass all manner of weaponry, including without limitation, guns such as handguns and rifles, heavy caliber guns, grenade launchers, cannons, howitzers, mortars, rocket launchers, and the like.

SUMMARY

In one aspect, a laser sighting system includes a fixed section having a housing and a fastener for providing a rigid connection of the fixed section to a weapon. A laser assembly includes one or more lasers, the laser assembly being rotatably attached to the fixed section and rotatable about an axis which extends in a direction that is generally transverse to a longitudinal axis of a barrel of the weapon. A processor assembly includes a processor and an associated computer readable memory encoded with executable instructions, the processor being configured, upon execution of the executable instructions, to receive input representative of a distance to a target and calculate a trajectory angle of the weapon based on the distance to the target, whereby the weapon will launch a projectile a distance that corresponds to the distance to the target. A motor mount is disposed within the fixed section and includes a projecting portion which extends into a complimentary cavity in the laser assembly, wherein the laser assembly is rotatable with respect to the motor mount. A motor is received within the motor mount and has a drive shaft coupled to the laser assembly. The motor configured to operate under the control of the processor assembly and the processor is configured, upon execution of the executable instructions, to operate the motor to rotate the laser assembly relative to the fixed section such that the barrel of the weapon will be aligned with the trajectory angle when an optical axis of the one or more lasers is aligned with the target.

In another aspect, a method is provided for aligning a barrel of a weapon with a trajectory angle in relation to a line of sight between the weapon and a target so that the weapon will launch a projectile a distance that corresponds to a distance to the target. The method includes inputting data representative of the distance to the target to a processor having an associated memory encoded with executable instructions. A fixed section having a housing is provided, the fixed section rigidly connected to the weapon. A laser assembly including one or more lasers is provided, the laser assembly rotatably attached to the fixed section and rotatable about an axis which extends in a direction which is generally transverse to a longitudinal axis of the barrel of the weapon. A motor mount disposed within the fixed section is provided and includes a projecting portion which extends into a complimentary cavity in the laser assembly, wherein the laser assembly is rotatable with respect to the motor mount. A motor received within the motor mount is provided and has a drive shaft coupled to the laser assembly, the motor being configured to operate under the control of the processor. The executable instructions are executed to calculate a trajectory angle of the weapon based on the distance to the target, the trajectory angle being calculated to cause a projectile fired by the weapon to be launched a distance that corresponds to the distance to the target. The executable instructions are executed to operate the motor to rotate the laser assembly relative to the fixed section such that the barrel of the weapon will be aligned with the trajectory angle when an optical axis of the one or more lasers is aligned with the target.

BRIEF DESCRIPTION OF DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
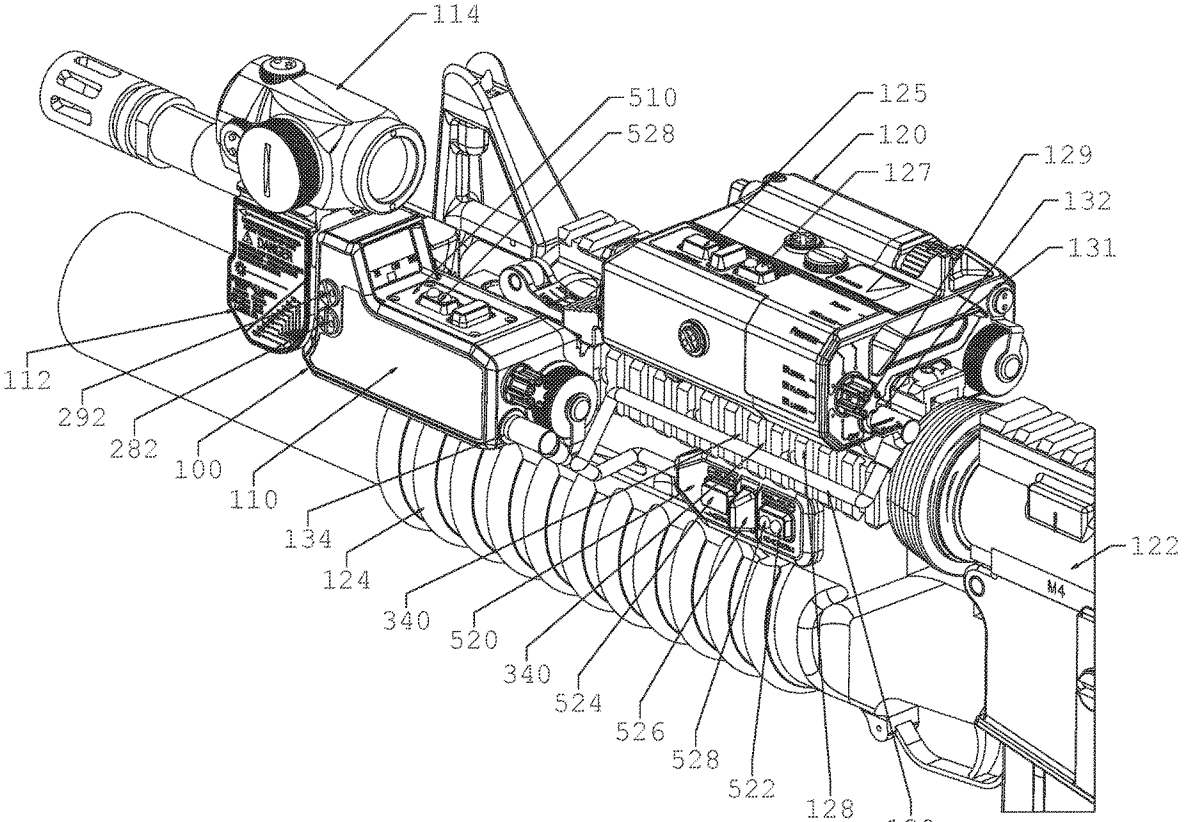
FIG. 1 is an isometric view, taken generally from the rear and left side, of an exemplary embodiment modular sighting assembly and range finder system.
Figure 2:
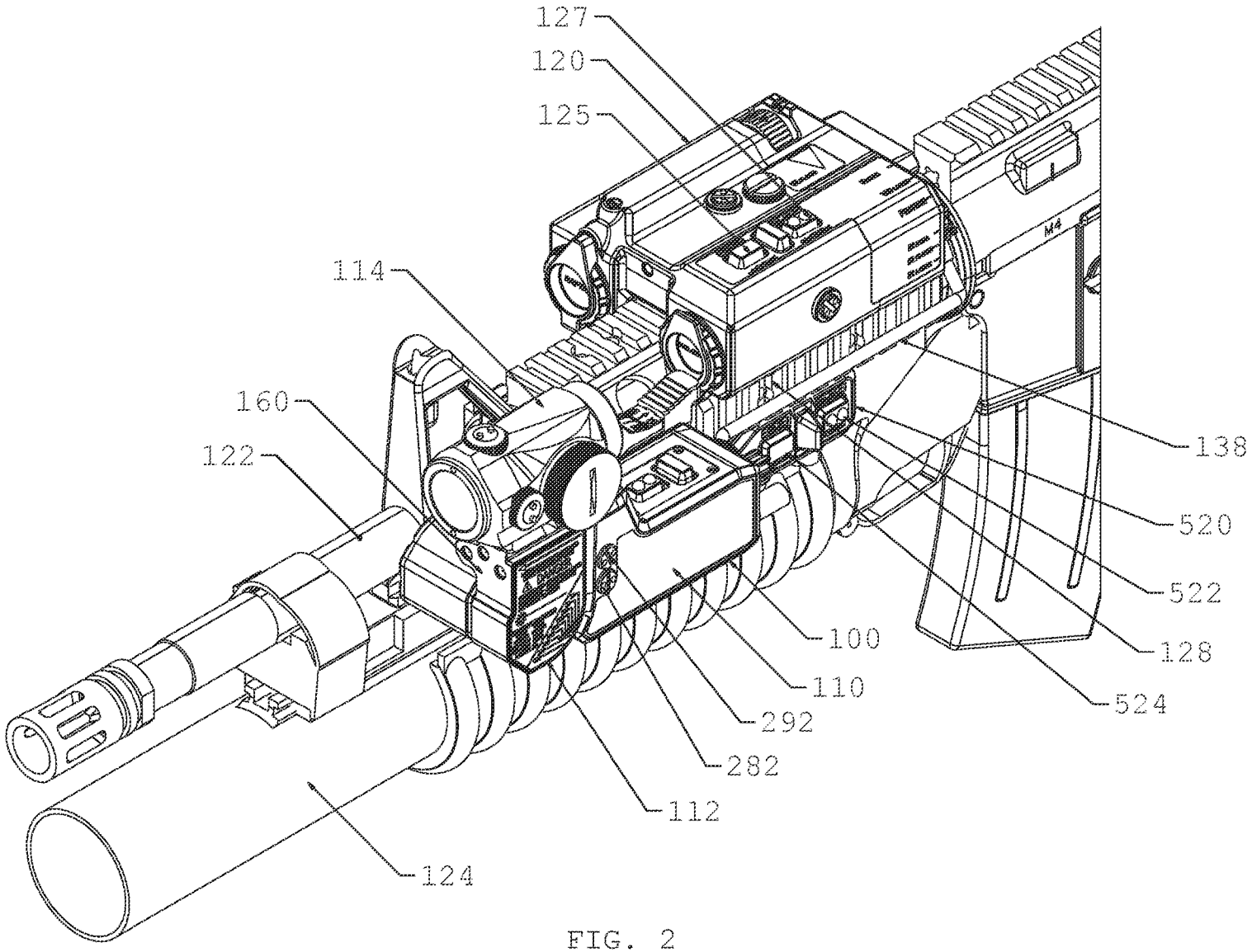
FIG. 2 is an isometric view, taken generally from the front and left side, of the system appearing in FIG. 1.

Referring to the drawings wherein like reference numerals refer to like or analogous components throughout the several views, an exemplary sighting assembly 100 is shown, which includes a fixed section 110 adapted to be removably attached to a weapon 122 and a rotating gimbal or turret section 112. As used herein, terms denoting direction or orientation, such as left, right, front, rear, upper, lower, horizontal, vertical, etc., are taken from the perspective of an user operating the unit 100 when the unit is mounted on a weapon, such as a firearm carrying a grenade launcher module 124 as illustrated in FIGS. 1 and 2, although use with other weapons systems are contemplated, including a standalone grenade launcher.

Figure 3:
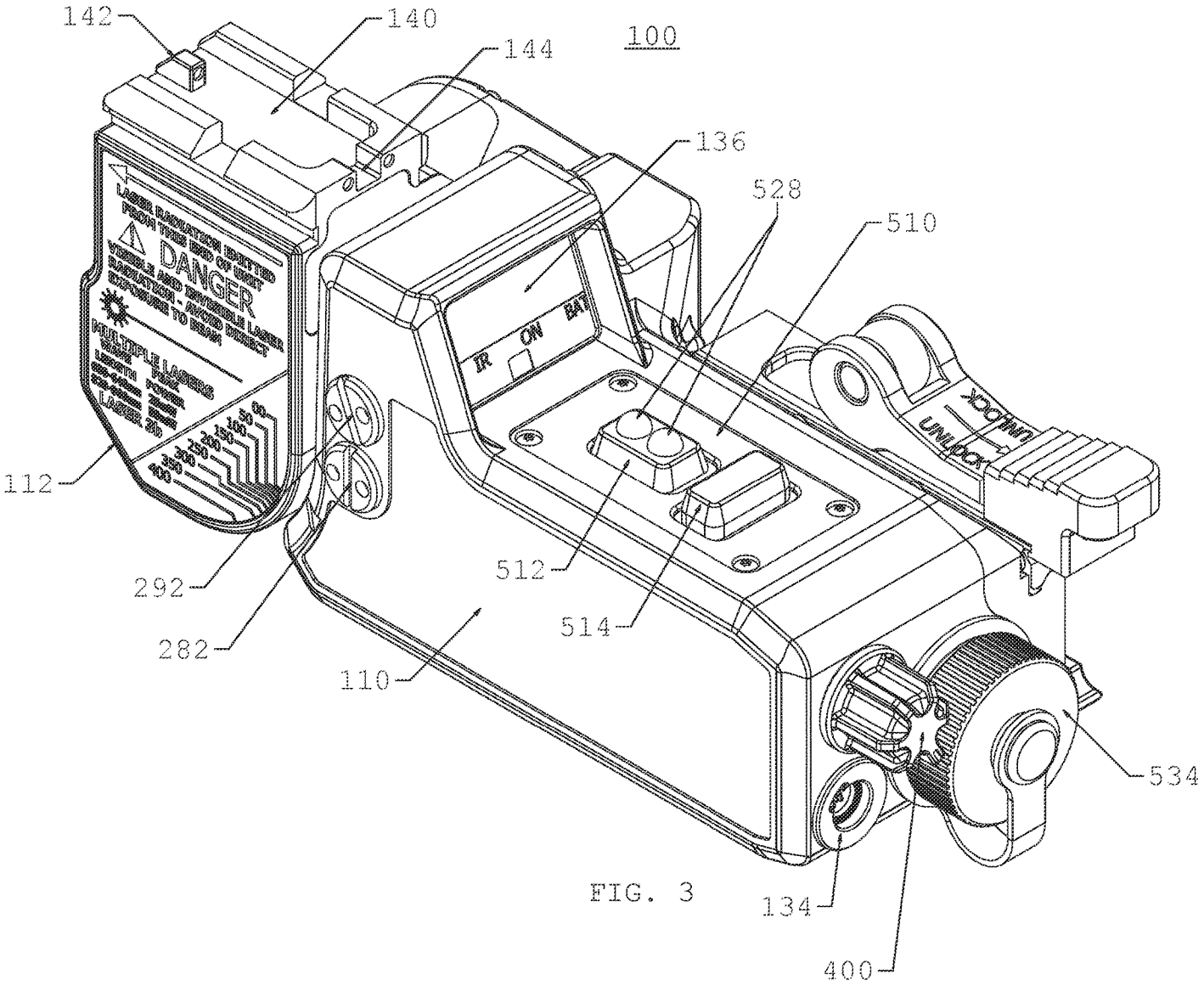
FIG. 3 is an enlarged isometric view of the modular sighting assembly herein taken generally from the rear and left side.
Figure 4:
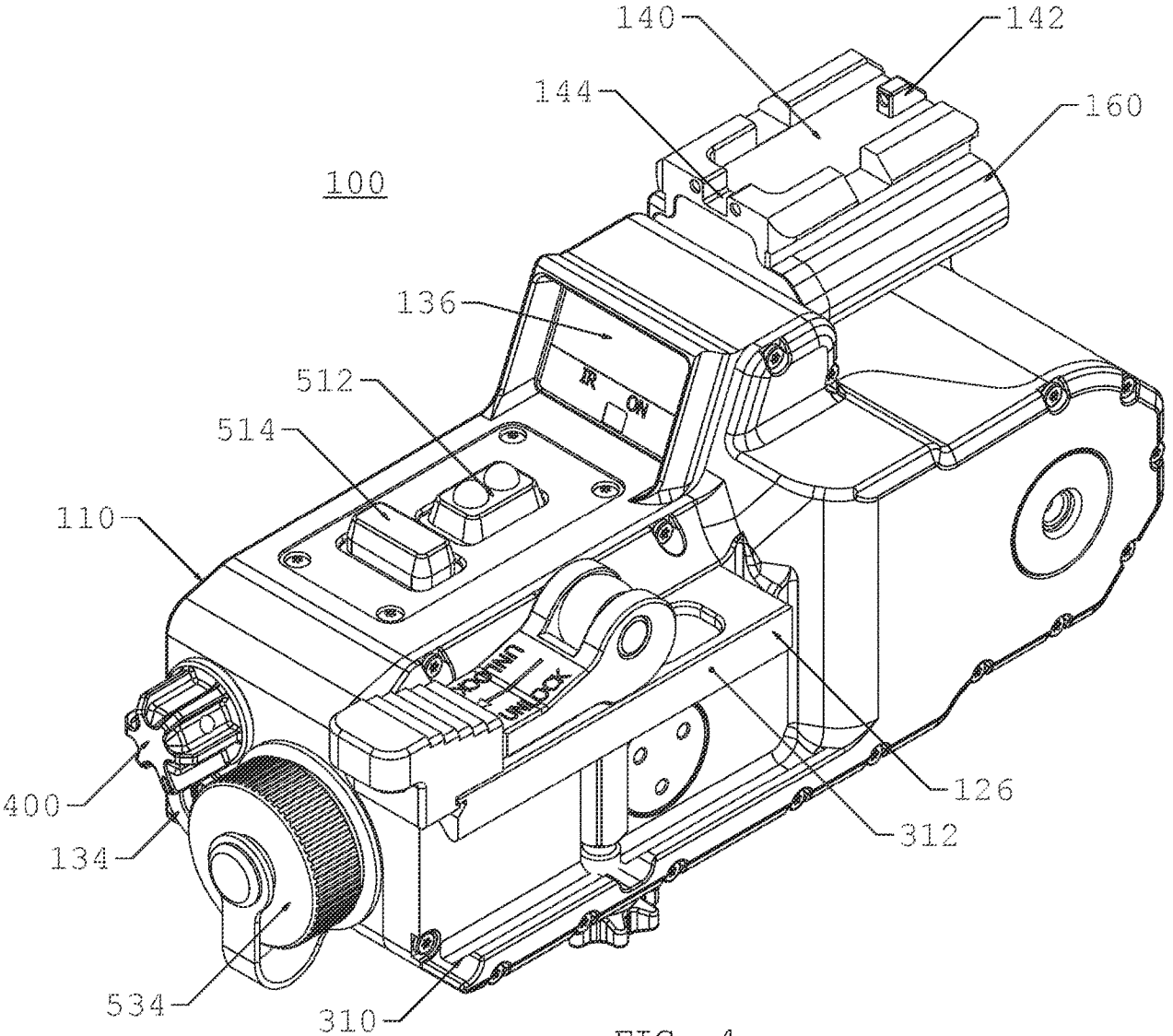
FIG. 4 is an enlarged isometric view of the modular sighting assembly herein taken generally from the rear and right side.
Figure 5:
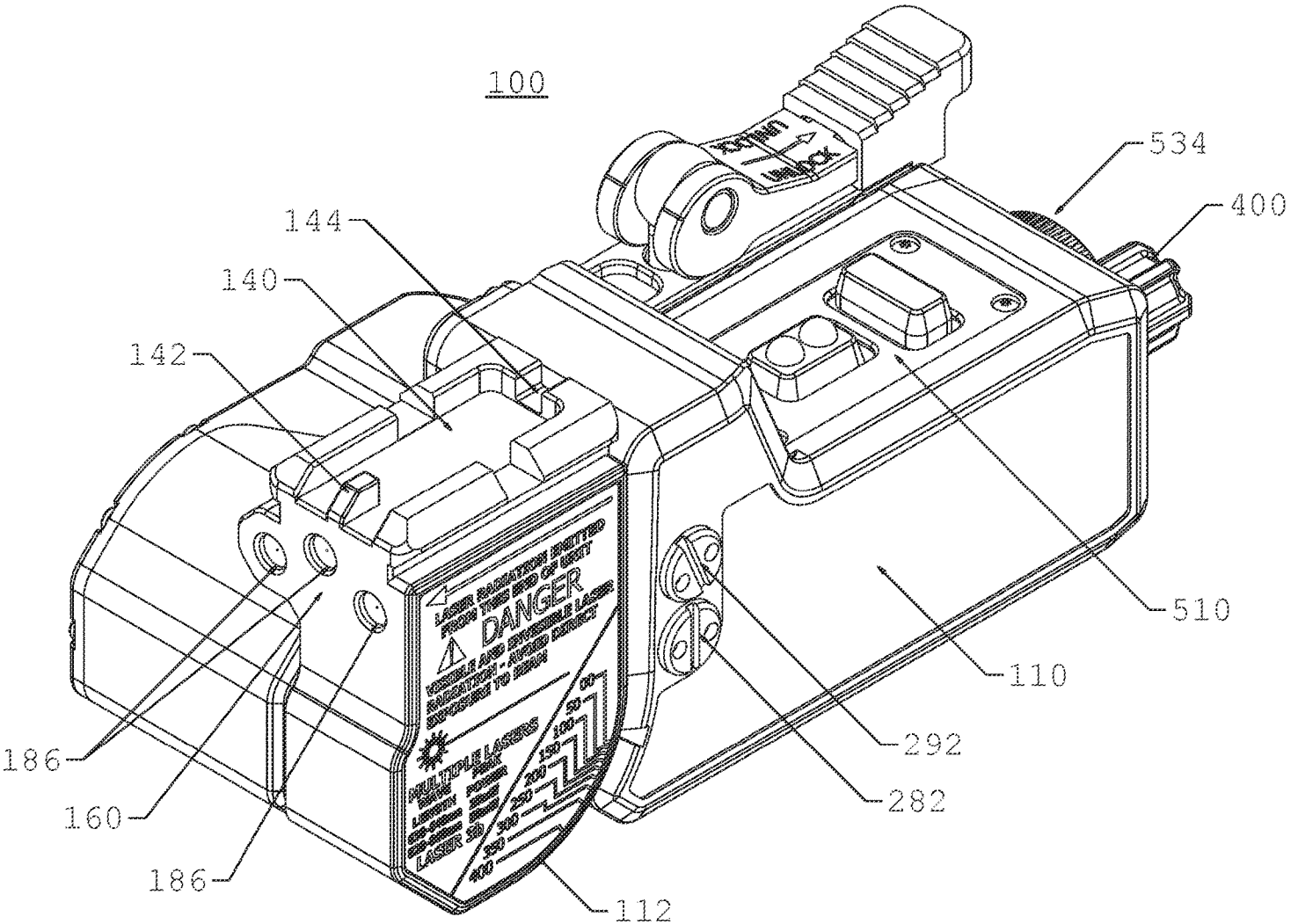
FIG. 5 is an enlarged isometric view of the modular sighting assembly herein taken generally from the front and left side.
Figure 6:
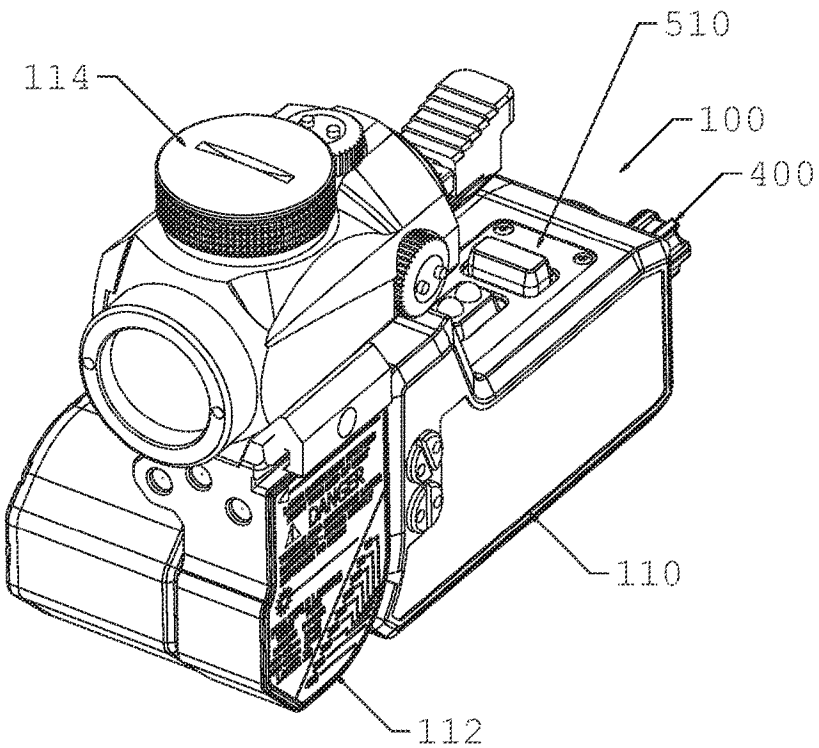
FIG. 6 illustrates the modular sighting assembly with a first reflex sight.

In operation, the user views the rear side of the sighting assembly 100, best seen in FIGS. 3 and 4, which has a display 136. The front side of the unit 100, as best seen in FIGS. 5 and 6, is opposite the rear side and faces away from the user during operation, toward the selected target. The right side (see FIG. 4), is adapted to be attached to the left side of the weapon 122, such as a military rifle having a grenade launcher 124 attached thereto (see FIGS. 1 and 2). The grenade launcher 124 may be an XM320 grenade launcher module or the like. Again, it will be recognized that other mounting configurations are possible and the sighting assembly 100 may be adapted to the type or types of firearm or artillery with which the sighting assembly 100 is to be used.

In the illustrated embodiment, the right side of the sighting assembly 100 includes a rail clamp assembly 126. In the depicted embodiment, the rail clamp 126 is adapted to fasten the sighting assembly 100 to a conventional "Picatinny" accessory rail 128, e.g., MIL-STD-1913, STANAG 2324, STANAG 4694 or the like on the left side of the weapon 122. It will be recognized that the rail clamp 126 could be adapted for use with other rail or accessory mounting interfaces.

Figure 12:
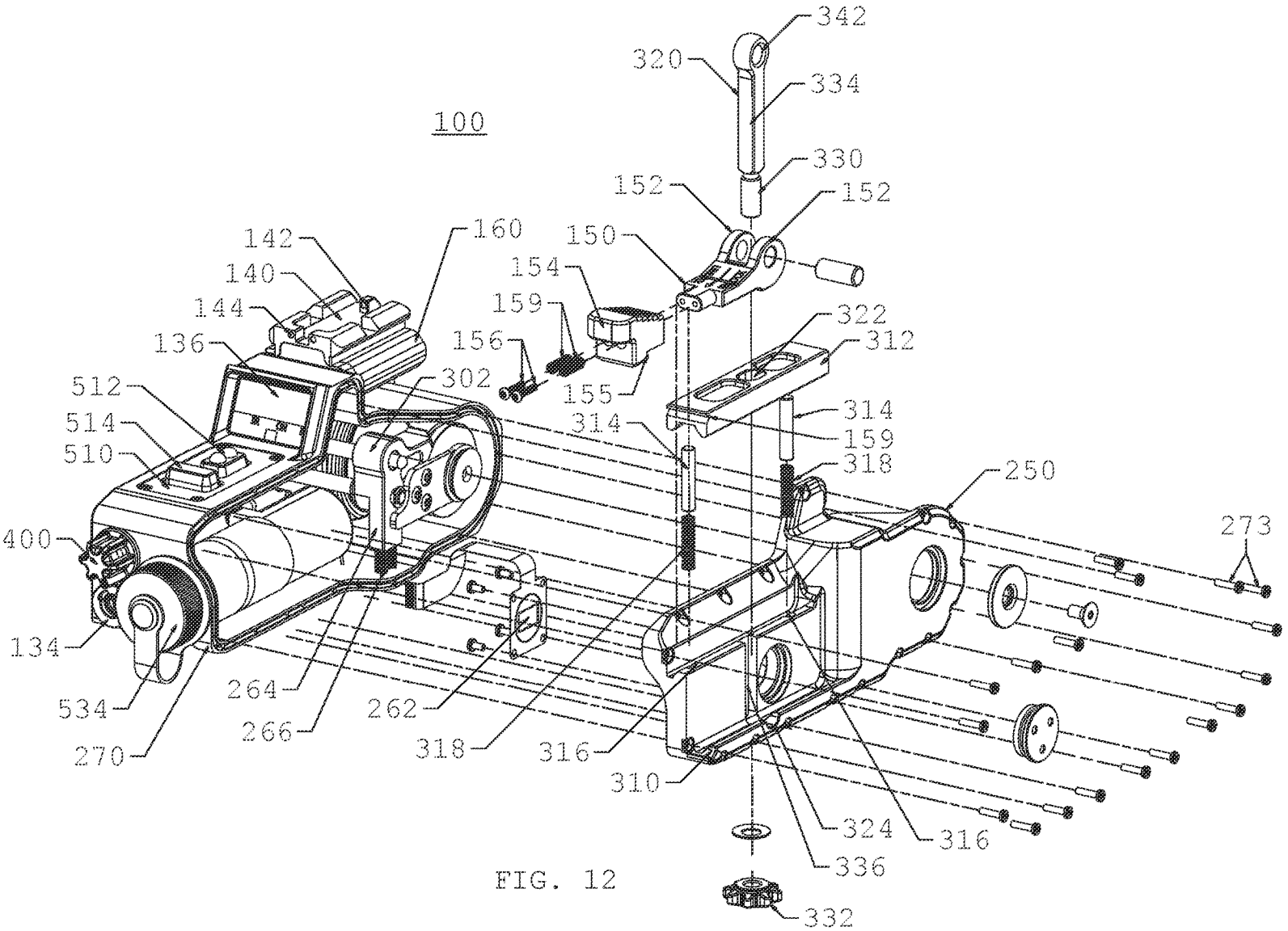
FIG. 12 is a partially exploded isometric view of the modular sighting assembly taken generally from the rear and right side illustrating the construction of the rail clamp.
Figure 13:
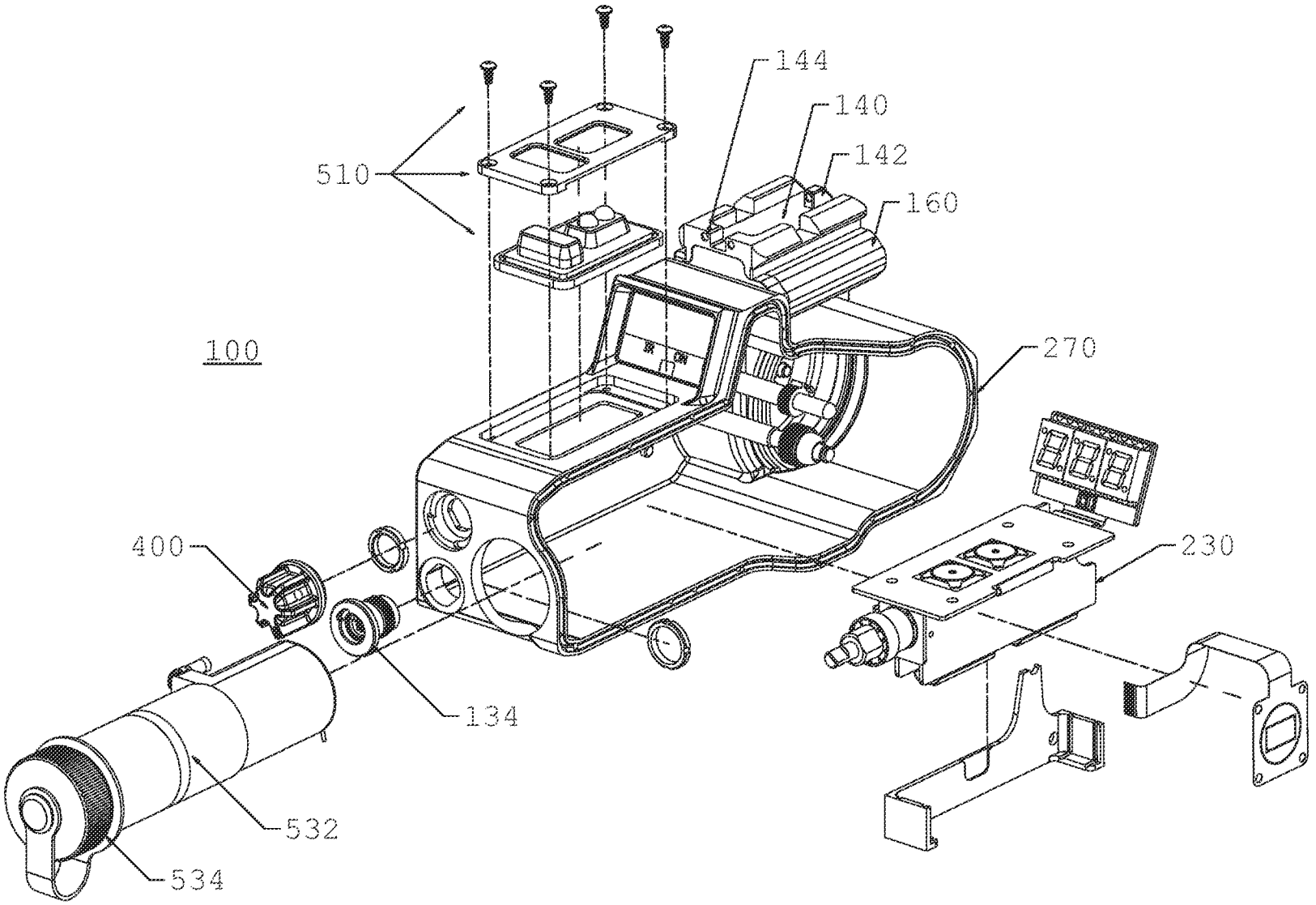
FIG. 13 is a partially exploded isometric view of the modular sighting assembly taken generally from the rear and right side illustrating the electrical components.
Figure 14:
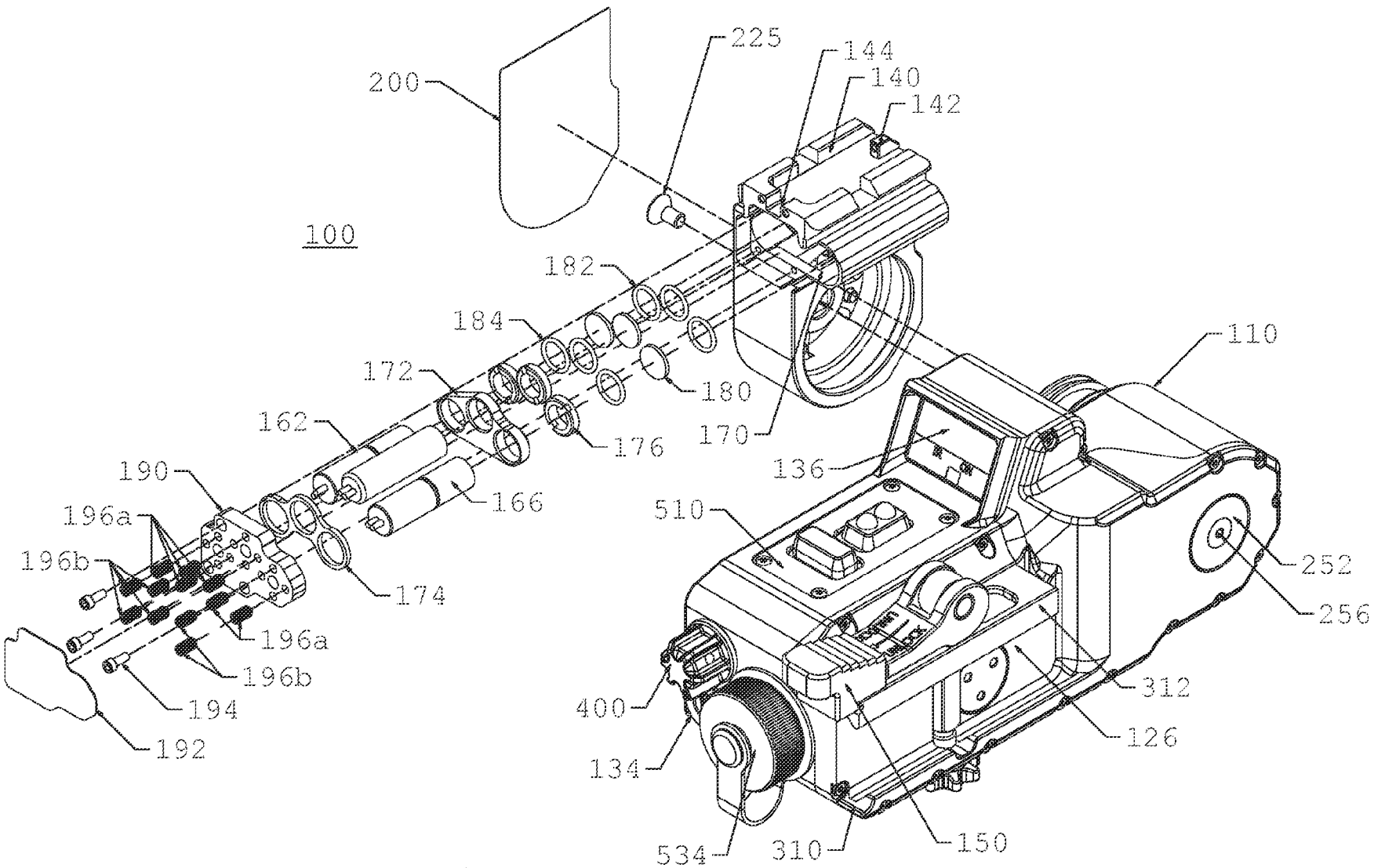
FIG. 14 is a partially exploded isometric view of the modular sighting assembly illustrating the laser assembly.

As best seen in FIG. 12, the rail clamp assembly 126 includes a fixed clamping jaw 310 configured to engage a first transverse side of the accessory rail 128 and a movable clamping jaw 312 configured to engage a second transverse side of the accessory rail 128. The fixed clamping jaw is integral with a housing base section 250 of the fixed portion 110. The moveable jaw 312 is attached to a pair of axially spaced apart pins 314 which are slidably received in corresponding bores 316 in the base section 250. Sliding movement of the pins 314 in the bores 316 allow the movable clamping jaw to move in the transverse direction relative to the fixed jaw. A coil spring 318 is received in each of the bores 316 to bias the movable clamping jaw away from the fixed jaw.

A cross bar 320 extends through an opening 322 in the movable jaw member 312 and an opening 324 in the fixed jaw member 310. The cross bar 320 includes a threaded end 330 which rotatably engages a nut 332 which is manually rotatable to selectively loosen and tighten the cross bar 320. The cross bar 320 includes a center stop bar section 334 which is preferably rectangular in cross sectional shape and which is received within a groove 336 extending transversely between the fixed jaw 310 and the movable jaw 312. The depth of the groove 336 is less than the thickness of the stop bar portion 334 such that the portion of the stop bar that stands proud of the channel 336 is received within and is complementary with a desired one of the cross slots 340 on the rail 128. The upper end of the cross bar 320 includes an opening 342.

A cam lever 150 is used to manually rotate a pair of cam surfaces 152 which engage the upper surface of the movable jaw member 312. A thumb grip 154 is attached to the end of the cam lever 150 with threaded fasteners 156 to facilitate manually pivoting the lever 150 between the locked and unlocked position. The lever 150 pivots about pivot pin 158 received within off center or eccentric openings 159 and the opening 342 to selectively secure and release the clamp 126. In operation, when the lever is pivoted to the unlocked position, the springs 318 urge the movable jaw 312 and slide pins 314 away from the fixed jaw 310 for removal of the unit 100 from the weapon 122. Protrusion 155 on the thump grip 154 engages a groove 157 on the movable jaw member 312. Springs 159 bias the thumb grip toward the latched position to prevent inadvertent release of the cam lever 150.

The sighting assembly 100 is used in conjunction with an optical range finder 120, which includes an optical transmitter and receiver of the type which calculates a distance to a target by measuring the time interval between the emission of an optical signal by the transmitter and detection of the reflected signal by the receiver. The range finder assembly 120 may be a RAPTAR™ range finder unit available from Wilcox Industries Corp. of Newington, N.H.

A data signal representative of the calculated distance to a target performed by the range finder 120 is output to the sighting assembly 100 via a cable 138 having a first end coupled to an output data port 132 of the range finder 120 and a second end coupled to an input data port 134 of the unit 100. The cable may be a Y-cable for simultaneously connecting a remote control key/button pad 520 described below.

The distance to the target as determined by the rangefinder 120 may be output to a human viewable display 136 located on the rearward facing side of the unit 100. The display unit 136 may be any display type and is preferably a light emitting diode (LED) display or liquid crystal display (LCD). Advantageously, the display may be a seven-segment LED or LCD display of a type used to display alphanumeric characters, and may be a backlit LCD display.

Figure 7:
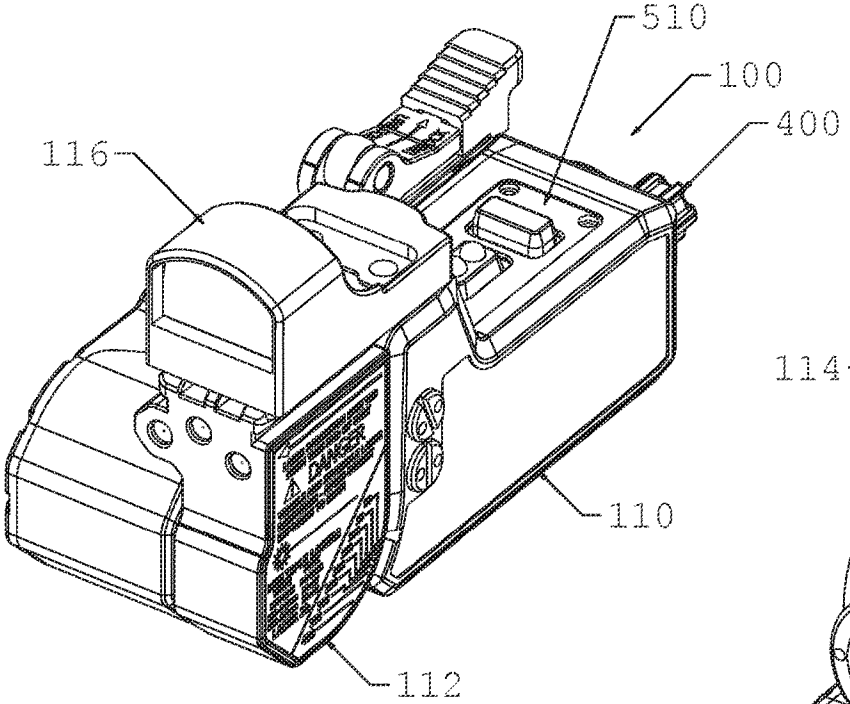
FIG. 7 illustrates the modular sighting assembly with a second reflex sight.
Figure 8:
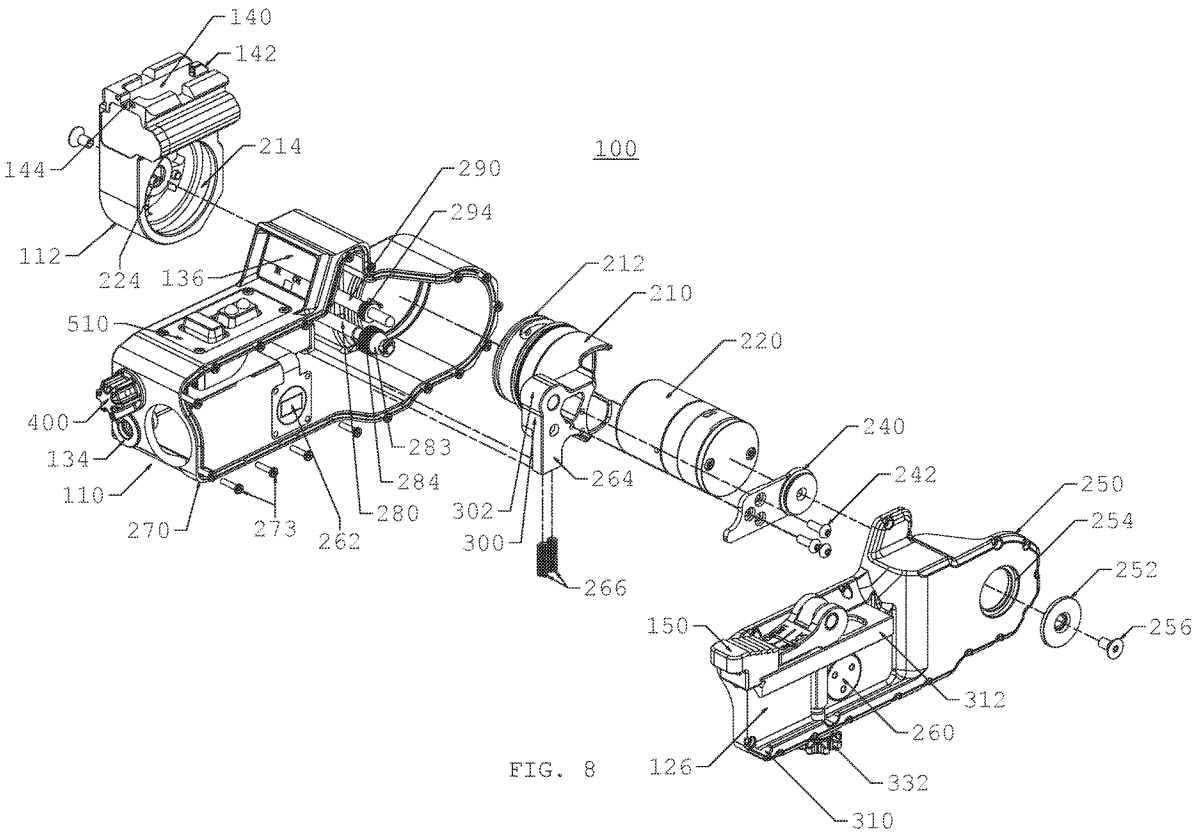
FIG. 8 is a partially exploded isometric view of the modular sighting assembly taken generally from the rear and right side.
Figures 9, 10, 11:
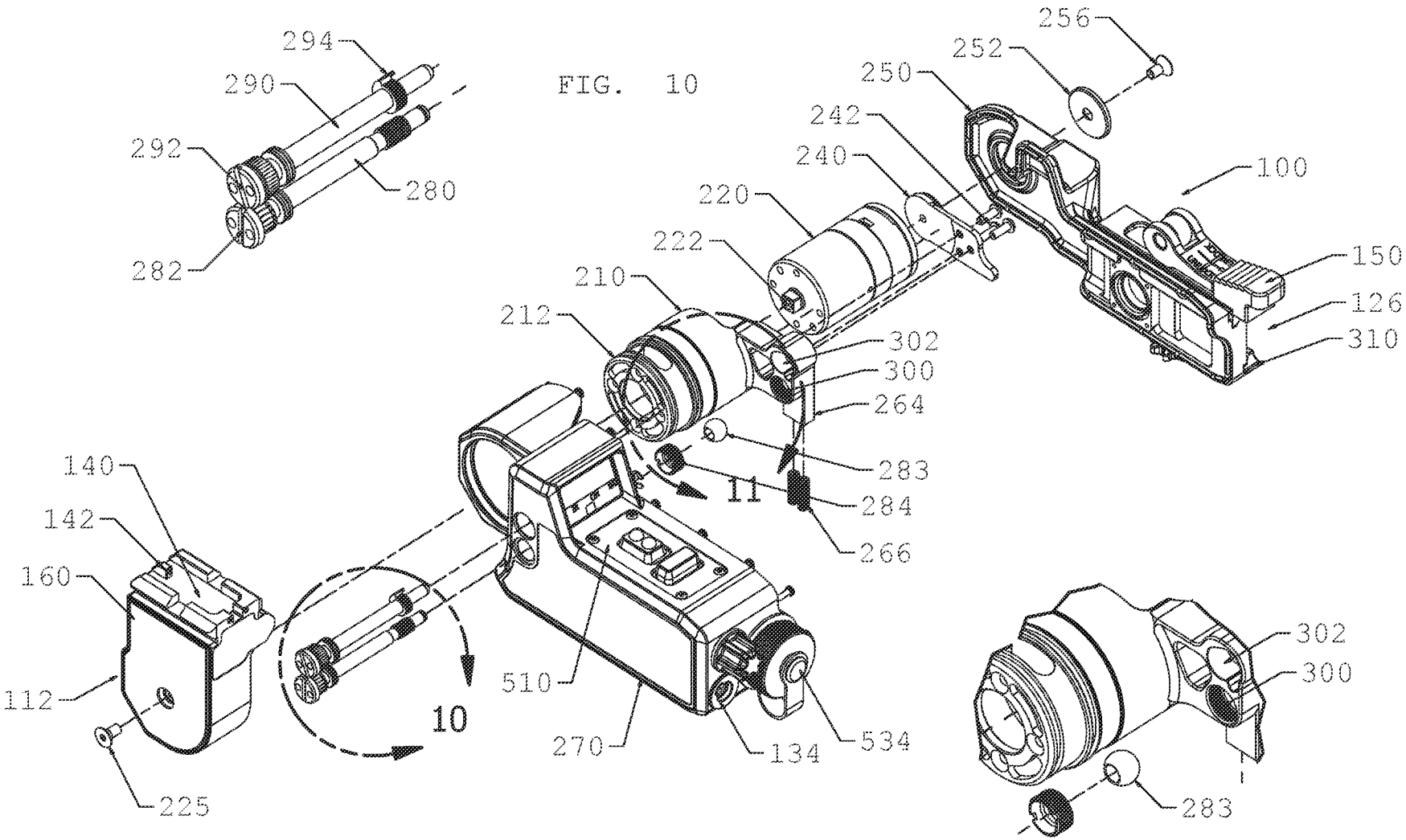
FIG. 9 is a partially exploded isometric view of the modular sighting assembly taken generally from the rear and left side.
FIG. 10 is an enlarged view of the region 10 appearing in FIG. 9.
FIG. 11 is an enlarged view of the region 11 appearing in FIG. 9.

The sighting assembly 100 is advantageously used with an attached sight such as a reflex or red dot sight 114 (see FIGS. 1, 2, and 6) or 116 (see FIG. 7), which is removably coupled to the rotating section 112. Other types of attached sights, such as an optical The upper surface 140 of the rotating section 112 is configured as a short section of firearm accessory rail (e.g., MIL-STD-1913, STANAG 2324, STANAG 4694, etc.) for attachment to an existing rail clamp on the bottom of the sight 114 or 116.

In the illustrated embodiment, the upper surface of the rotating section 112 includes front and rear fixed or mechanical sights 142 and 144, respectively, which allows the assembly 100 to be used to sight onto a target without an attached sight 114 or 116. Other fixed or mechanical iron sight configurations are also contemplated.

The rotating section 112 includes a laser assembly 160 having one or more lasers (three in the illustrated embodiment) 162, 164, and 166. The lasers may include an infrared pointing laser (e.g., for use with night vision equipment), a visible pointing laser (e.g., for use under daylight conditions) and an infrared illuminator (e.g., for illumination of a target under nighttime or low light conditions for viewing with night vision equipment).

The laser assembly 160 is housed within a cavity 170 within the rotating section 112 and includes the lasers 162, 164, 166, which are received between front and rear frame members 172 and 174, respectively. Caps 176 having a central opening for passage of the laser beam emitted by the lasers 162, 164, and 166 are disposed on the front frame member 172. Focusing lenses 180 are positioned in front of the respective lasers 162, 164, 166, and behind aligned apertures 186 in the front wall of the cavity 170 and may be sealed with O-rings or gaskets 182, 184 to prevent entry of moisture of environmental contamination.

The cavity 170 is closed at its rear end with an adjustment plate 190 and an outer finish plate 192. Fastening screws 194 secure the adjustment plate 190 over the opening to the cavity 170. Three pairs of set screws 196*a*, 196*b* are for providing a fine adjustment of the optical axis of each laser independently of the other lasers. Each of the set screws 196*a* are positioned along a horizontal centerline of a respective one of the lasers and can be selectively advanced or retracted to provide a side-to-side adjustment of each laser. Each of the setscrews 196*b* are positioned along a vertical centerline of a respective one of the lasers and can be selectively advanced or retracted depending on the direction of rotation to provide an up or down adjustment of each laser. Once the lasers are optically aligned, a potting material such as epoxy or other material may be used to permanently retain the lasers in alignment with each other.

A side finish plate 200 is attached to a left side of the rotating section 112. Although it is contemplated that the set screws 196*a*, 196*b* could be used to boresight the laser assembly to the weapon 122 and/or 124, in a preferred embodiment, the set screws are used to ensure that all of the lasers are aligned parallel to each other and the windage and elevation adjustments are used to boresight the sighting assembly to the weapon, as described in greater detail below.

The rotating portion 112 carrying the laser assembly 160 is rotatably attached to a motor mount 210 mounted within the fixed section 110. The motor mount 210 includes a projection 212 which extends into a complimentary cavity 214 within the section 112, such that the section 112 is rotatable relative to the motor mount 210. A motor 220 is, in turn, received within the motor mount 210 and includes a drive shaft 222 which engages a complementary opening 224 in the cavity 214. The drive shaft 222 and opening 224 preferably have a square or other noncircular cross-sectional shape. The shaft 222 is secured with a threaded fastener 225.

In operation, the motor rotates the gimbal portion 112 under the control of a ballistics computer 230 to a desired angle with respect to the fixed portion 110. The angle is calculated by the on board ballistics computer 230 based on the range determined by the range finder 120, or as otherwise set by the user as described below, and the ballistic properties of the grenade launcher (or other weapon). The ballistics computation may also take into consideration other ballistic factors, such as elevation, wind speed, temperature, and so forth. The gimbal is rotated under programmed control to a calculated angle such that the trajectory path of a fired projectile will intersect with the line of sight between the operator and the target at or near the target when (1) a selected one of the pointing lasers is pointed at the target; (2) a dot or reticle of the reflex sight 114, 116 is aligned with the target; and/or (3) the mechanical sights 142, 144 are aligned with the target.

A motor mount back plate 240 is attached to the motor mount 210 via threaded fasteners 242 to secure the motor 220 within the motor mount. A top hat flange 252 is received within an opening 254 in the right side housing plate 250 and a threaded fastener 256 engages a fastener 244 on the back plate 240 to anchor the motor mount 210 to the housing plate 250. The plate 250 includes a cover 260 which is removably to provide access to a data or programming port 262, such as a serial or parallel data interface port, which may be provided for programming, updating, or testing the ballistics computer or processor assembly 230 (including an associated memory thereof).

The motor housing 210 includes a downward extending leg 264 which includes one or more openings receiving the first end of one or more springs 266. The second end of the one or more springs bear against the base of the housing shell 270 to provide an upward pivoting bias to the motor housing 210.

A windage adjustment rod 280 is provided to provide a horizontal bore sighting adjustment for bore sighting the sighting assembly to the weapon 122 and/or 124. An elevation adjustment rod 290 is provided to provide a vertical bore sighting adjustment of the sighting assembly to the weapon 122 and/or 124.

The windage rod 280 includes a manually rotatable knob portion 282 at a first end of the rod 280 and a ball 283 and collar or socket 284 attached via threads on the second end of the rod 280. The ball is captured within a cavity 300 in the motor mount. Rotation of the rod 280 in one direction advances the ball and rotation in the opposite direction retracts the ball, thereby imparting a side-to-side movement of the motor housing relative to the housing 270. Since, in use, the housing plate 250 of the fixed portion 110 is rigidly secured to the rail interface of a weapon, and the housing shell 270 of the fixed portion 110, in turn, is rigidly secured to the plate 250 via a plurality of threaded fasteners 273, rotation of the windage knob 280 causes movement of the motor housing and thus the motor 220 and the laser assembly portion 112 relative to the weapon. This is in contrast with conventional windage adjustments, which commonly adjust only the position of the laser within the housing.

The elevation rod 290 includes a manually rotatable knob portion 292 and a cam 294, which is rotatably received within an opening 302 formed in the motor mount 220. The interior surface of the opening 302 acts as a cam follower, wherein rotation of the rod 290 in a first direction causes a pivoting movement of the motor housing relative to the housing shell members 220, 270 in a first direction and rotation of the rod 290 in the opposite direction causes pivoting movement of the motor housing in the 220 in the opposite direction, thereby providing an up and down adjustment for bore sighting the sighting assembly 100 to the weapon. Since, in use, the housing of the fixed portion 110 defined by the shell members 250 and 270 is rigidly secured to rail interface of a weapon, rotation of the elevation knob 290 causes movement of the motor housing and thus the motor and the laser assembly portion 112 relative to the weapon. This is in contrast with conventional elevation adjustments, which commonly adjust only the position of the laser within the housing.

During a bore sighting operation, as the elevation knob 290 is rotated, the elevation angle of the rotatable portion 112 is pivoted up and down relative to the stationary fixed portion 110. Likewise, as the windage knob 280 is rotated, the windage angle of the rotatable portion 112 is adjusted side-to-side relative to the stationary fixed portion 110.

A selector switch 400 on the fixed portion 110 is provided to power the unit on and off and preferably is a multi-position rotary selector switch to allow the selection from among multiple modes of operation. In addition, a control pad 510, comprising an "input" button 512 and an "enable" button 514, whose operation will be described below, is provided.

Rotating the selector switch 400 to a first, power off position results in the unit 100 being powered off.

Rotating the selector switch 400 to a second, "connected" position results in the unit 100 being tied or linked to the laser range finder 120 via the connector cable 138. In the connected mode, range data from the range finder 120 is sent to the unit 100 for use by the ballistics processor 230. In the preferred embodiments, when the unit 100 is operated in the connected mode, the control pad 510 is disabled and operation of the unit 100, including the selection of laser power and type, is controlled by using the buttons 125 and 127 and laser selection switch 129 on the laser range finder 120. Likewise, when used in the connected mode, pointing and illumination lasers on the range finder 120 are disabled and the lasers 162, 164, and 166 are operative.

Rotating the selector switch 400 to a third "IR pointer" position allows the unit 100 to be used as a standalone device, independent of the rangefinder 120. In the IR pointer mode, the rotatable turret 112 may be manually rotated to provide a range select function. In operation, the turret 112 is manually rotated until a desired range to target is displayed on the display 136. In this mode, the IR pointing laser is turned on and off by pressing the input button 512. Preferably, the button 512 acts as a toggle to toggle the IR pointing laser on and off, e.g., where pressing the button once turns the laser on and pressing the button a second time turns the laser off.

After the desired range is entered and is displayed on the display 136, pressing the enable button 514 causes the ballistics processor to calculate a ballistic solution for the input range to target, and optionally any other ballistics factors such as tilt and temperature, and then rotates and holds turret 112 to a desired rotational position. Pressing the enable button 514 a second time deselects ballistic solution and allow operator to dial the turret 112 to another target.

Rotating the selector switch 400 to a fourth "IR flood" position also allows the unit 100 to be used as a standalone device, independent of the rangefinder 120, and is as described above by way of reference to the IR pointer mode, except the IR illuminator/flood laser is actuated by the button 512.

Rotating the selector switch 400 to a fifth "IR dual" position again allows the unit 100 to be used as a standalone device, independent of the rangefinder 120, and is as described above by way of reference to the IR pointer and IR flood modes, except that both the IR illuminator and IR pointer lasers are actuated simultaneously by the button 512, i.e., such that the IR pointing laser appears as a dot centered within a broader illumination beam when viewed with a night vision device.

Rotating the selector switch 400 to a sixth "visible laser" position also allows the unit 100 to be used as a standalone device, independent of the rangefinder 120, and is as described above by way of reference to the IR pointer, flood, and dual modes, except that the visible laser is actuated by the button 512.

Rotating the selector switch 400 to a seventh "function" position allows users to access user settings and options using a menu driven hierarchy that is navigated using the buttons 512 and 514. Exemplary settings and options that can be accessed using the function position include back light intensity for the display 136, software revisions, estimated battery life remaining, system test, and default settings. Another function that can be accessed is a cant function to enable or disable cant sensing, e.g., to provide a visual indication as to the side-to-side rotation of the unit 100 to ensure the associated weapon is in an appropriate position for firing (e.g., substantially horizontal relative to the horizon). Another function that may be accessed in the function position is laser power. For example, a setting may be provided to select between high power and low power laser output. Still another setting that is selectable using the function position is the units of distance, e.g., selectable between meters or yards, of the displayed distance.

Rotating the selector switch 400 to an eighth "round type" position allows the user to select the type of round to be fired which, in turn, selects the appropriate ballistics tables for the ballistics calculation performed by the processor 230.

Indicia (not shown) representative of the mode corresponding to each rotational position of the switch 400 may be provided, e.g. via imprinting, on the housing 112. The remote control key pad 520 may also be provided having a first input switch or button 522 and second switch or button 524 which provide the same functions as the buttons 512 and 514, respectively. In the illustrated embodiment, a divider 526 is provided between the buttons 522 and 524 to allow the operator to distinguish between the two buttons and prevent inadvertent actuation of the wrong button. In preferred embodiments, the buttons 512 and 522 have tactile features 528 to enable the user to readily distinguish between the input button and the enable button.

Power is supplied to the processor assembly 230, the display 136, the lasers 162, 164, 168 and the motor 220 via one or more batteries or battery packs, e.g., one or more lithium batteries, housed in a battery compartment or tube 532, e.g., having a removable cover or sealed, hinged door 534. The processor assembly 230 includes a microprocessor or microcontroller and associated memory.

In an exemplary mode of operation, the user powers on the sighting assembly 100 by rotating the rotary switch 400 to a desired position, which selects the mode as described above and which of the pointing lasers will be actuated by the button 512 or 522. An indication that the sighting assembly has been powered on may be shown on the display, for example, by displaying three dashes, horizontal lines, a single dot or a text version of the selection on the display 136. In the preferred embodiment, the angular orientation of the pointing laser assembly relative to the axis of the range finder laser 130 is determined and, if it is not at the zero position, it is automatically returned to the zero position.

In some embodiments, the buttons 512 and 522 may operate as a toggle switch to toggle the selected one of the pointing lasers on and off or, alternatively, the button 512 and 522 may function as a momentary contact switch, e.g., to activate the selected pointing laser when the switch is depressed and to deactuate the selected pointing laser when the switch is released.

In certain embodiments, the time of the button press or button down events for the button 512 and 522 are monitored by the processor 230. If the time of a button down event is less than some predetermined value, such as one-half second, the buttons 512 and 522 function as a momentary contact switch, actuating the laser only when the button is depressed and deactivating the laser when the button is released. If the user holds the button down for a period of time that is greater than the preselected threshold, then the button 512 and 522 will function as a toggle switch and the pointing laser will remain on after the button is released. The user may then press the button 512 and 522 again to deactivate the pointing laser.

In the connected mode, the range finder 120 is actuated by depressing the button 125 or 127. Upon actuation of the range finder, the distance to the target is determined and data representative of the calculated distance to the target is sent to the sighting assembly 100 via the cable 138 and displayed on the display 136.

In the non-connected modes, the range finder 120 can be operated independently and the distance displayed on a display 131 of the range finder 120. In the non-connected modes of operation of the sighting assembly 110, the user may manually input the distance displayed on the display 131 to the sighting module 110. In certain embodiments, the distance to the target may be input to the sighting assembly 110 by manually rotating the rotatable portion 112 until the distance is displayed on the display 136, as described above.

The ballistics computation may be made based on the distance to the target and, optionally, other factors, such as barometric pressure, temperature, humidity, and so forth as would be understood by persons skilled in the art. In certain embodiments, barometric pressure, temperature, and humidity sensors may be provided on the unit and coupled to the processor 230.

In certain embodiments, the processor assembly 230 displays the actual (line of sight) distance received from the range finder 120 on the display unit 136. Alternatively, the user may have the option of displaying the effective "ballistics distance" which takes into account any difference in elevation between the user and the target. The inclination along the line of sight between the operator and the target may be determined using an onboard accelerometer or inclinometer.

In some instances, it may be undesirable to use the pointing lasers to sight onto the target. For example, the laser beam emitted by the lasers may be visible to others, thereby revealing the position of the operator and potentially compromising the operator's safety. Also, the user, in aligning the pointing laser sight with the target may have difficulty seeing the laser under bright light, e.g., daylight, conditions. In the depicted preferred embodiment, the sight 114, 116, or the iron sights 142, 144 may be used to sight onto the selected target instead of using the pointing laser sight to set the trajectory angle of the firearm or artillery. It is also contemplated that an auxiliary laser sight could be attached to the rail section 140 and used to sight onto the target, if desired.

Although the preferred embodiments herein show reflex sights 114, 116, it will be recognized that any other type of alternative sight may also be used, such as the iron sights 142, 144, a telescopic sight (e.g., a 2×, 3×, 4× optical sight), etc., although it is preferred to use a reflex or other sight which compensates for parallax which occurs when the user's head moves in relation to the sight.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. An apparatus for assisting the aiming of a weapon, comprising:

a laser sighting system for providing an aiming mark on a target of the weapon;

an optical range finder system for determining a distance to the target of the weapon, the optical rangefinder in communication with the laser sighting system;

the laser sighting system comprising:

a fixed section having a housing and a first fastener for providing a rigid connection of the fixed section at a first location on the weapon;

a laser assembly including one or more lasers, the laser assembly rotatably attached to the fixed section and rotatable about an axis which extends in a direction which is generally transverse to a longitudinal axis of a barrel of the weapon;

a processor assembly including a processor and an associated computer readable memory encoded with executable instructions, the processor configured, upon execution of the executable instructions, to receive input from the optical rangefinder representative of a distance to a target and calculate a trajectory angle of the weapon based on the distance to the target whereby the weapon will launch a projectile a distance that corresponds to the distance to the target;

a motor mount disposed within the fixed section and including a projecting portion which extends into a complimentary cavity in the laser assembly, wherein the laser assembly is rotatable with respect to the motor mount;

a motor received within the motor mount and having a drive shaft coupled to the laser assembly, the motor configured to operate under the control of the processor assembly; and the processor configured, upon execution of the executable instructions, to operate the motor to rotate the laser assembly relative to the fixed section such that the barrel of the weapon will be aligned with the trajectory angle when an optical axis of the one or more lasers is aligned with the target;

the optical rangefinder system comprising an optical emitter for sending an optical signal to the target, an optical detector for detecting the signal reflected from the target, and a second fastener for mounting the optical rangefinder system at a second location on the weapon.

2. The apparatus of claim 1, wherein the laser sighting system further comprises:

a sight attached to the laser assembly and optically aligned with the one or more lasers, the sight selected from the group consisting of a mechanical sight, a reflex sight, a telescopic sight, or any combination thereof.

3. The apparatus of claim 1, wherein the laser sighting system further comprises a display configured to display the distance to the target in human viewable form.

4. The apparatus of claim 1, wherein the optical rangefinder is operatively coupled to the laser sighting system via a cable connection.

5. The apparatus of claim 1, wherein the processor is configured, upon execution of the executable instructions, to operate in a first mode wherein the input representative of a distance to a target is received from an associated range finder and a second mode wherein the input representative of a distance to a target is manually input by a user.

6. The apparatus of claim 5, wherein the laser assembly is manually rotatable with respect to the fixed section and further wherein the processor is configured, upon execution of the executable instructions, to receive input representative of a distance to a target based on a degree of manual rotation of the laser assembly.

7. The apparatus of claim 1, wherein the motor mount is movable within the housing.

8. The apparatus of claim 1, further comprising a windage adjustment assembly, the windage adjustment assembly including:

a windage adjustment rod having a first end rotatable by a user and a second end attached to the motor mount, wherein rotation of the windage adjustment rod in a first direction is configured to impart a side-to-side adjustment of an aiming direction of the laser assembly in a first side-to-side direction and rotation of the windage adjustment rod in a second direction is configured to impart a side-to-side adjustment of the aiming direction of the laser assembly in a second side-to-side direction.

9. The apparatus of claim 8, wherein the windage adjustment assembly includes a threaded rod rotatably engaging a threaded opening in the motor mount.

10. The apparatus of claim 9, further comprising a ball and socket joint joining the threaded rod and the windage adjustment rod.

11. The apparatus of claim 1, further comprising an elevation adjustment assembly, the elevation adjustment assembly including:

an elevation adjustment rod having a first end rotatable by a user and a second end coupled to the motor mount, wherein rotation of the elevation adjustment in a first direction is configured to impart an upward adjustment of an aiming direction of the laser assembly and rotation of the elevation adjustment in a second direction is configured to impart a downward adjustment of an aiming direction of the laser assembly.

12. The apparatus of claim 11, wherein the elevation adjustment assembly includes an eccentric cam attached to the elevation adjustment rod and received within an opening in the motor mount, the eccentric cam configured to impart vertical movement of the motor mount responsive to rotation of the elevation adjustment rod.

13. The apparatus of claim 1, further comprising a remote control unit operatively coupled to the processor assembly for controlling operation of the laser sighting system.

14. The apparatus of claim 1, wherein laser assembly includes one or more pointing lasers.

15. The apparatus of claim 14, wherein the laser assembly further includes at least one illumination laser.

16. The apparatus of claim 1, wherein the laser assembly includes a first pointing laser which is operable to emit infrared radiation, a second pointing laser which is operable to emit visible radiation, and an illumination laser which is operable to emit infrared radiation, wherein the first pointing laser, the second pointing laser, and the illumination laser are optically aligned with each other to emit radiation in the same direction along parallel optical axes.

17. The apparatus of claim 1, wherein the laser assembly includes a plurality of lasers and a plurality of adjustment set screws engaging each laser, each of the adjustment set screws rotatable to adjust an optical axis of such laser independently of the other lasers in said plurality of lasers.

18. The apparatus of claim 1, wherein the weapon includes a grenade launcher attached to a rifle.

19. The laser sighting system of claim 1, wherein each of the first fastener and second fastener is a weapon accessory rail clamp.

20. The laser sighting system of claim 19, wherein the weapon accessory rail clamp is configured for removable attachment to a Picatinny accessory rail.

21. A method for aligning a barrel of a weapon with a trajectory angle in relation to a line of sight between the weapon and a target so that the weapon will launch a projectile a distance that corresponds to a distance to the target, said method comprising:

providing a laser sighting system and a first fastener to attach the laser sighting system at a first location on the weapon, the laser sighting system for providing an aiming mark on a target of the weapon, the laser sighting system having:

a fixed section having a housing, the fixed section being rigidly connected to the weapon;

a laser assembly including one or more lasers, the laser assembly rotatably attached to the fixed section and rotatable about an axis which extends in a direction which is generally transverse to a longitudinal axis of the barrel of the weapon;

a motor mount disposed within the fixed section and including a projecting portion which extends into a complimentary cavity in the laser assembly, wherein the laser assembly is rotatable with respect to the motor mount;

a motor received within the motor mount and having a drive shaft coupled to the laser assembly, the motor configured to operate under the control of the processor;

providing an optical range finder system and a second fastener to attach the optical range finder system at a second location on the weapon, the optical range finder system for determining a distance to the target of the weapon, the optical rangefinder in communication with the laser sighting system;

using the optical range finder system to obtain data representative of the distance to the target;

inputting the data representative of the distance to the target from the optical rangefinder system to a processor associated with the laser sighting system, the processor having an associated memory encoded with executable instructions;

executing the executable instructions to calculate a trajectory angle of the weapon based on the distance to the target, the trajectory angle being calculated to cause a projectile that is fired by the weapon to be launched a distance that corresponds to the distance to the target; and executing the executable instructions to operate said motor to rotate the laser assembly relative to the fixed section such that the barrel of the weapon will be aligned with the trajectory angle when an optical axis of the one or more lasers is aligned with the target.

22. The method of claim 21, wherein the processor is further configured to receive manual user input representative of the distance to the target.

23. The method of claim 21, further comprising one or both of:

aligning said optical axis of the one or more lasers with the target; and attaching a sight to the laser assembly in optical alignment with said optical axis of the one or more lasers with the target and aligning the sight with the target.

24. An apparatus for assisting the aiming of a weapon, comprising: a laser sighting system for providing an aiming mark on a target of the weapon; an optical range finder system for determining a distance to the target of the weapon, the optical rangefinder in communication with the laser sighting system; the laser sighting system comprising: a fixed section having a housing and a first fastener for providing a rigid connection of the fixed section at a first location on the weapon; a laser assembly including one or more lasers, the laser assembly rotatably attached to the fixed section and rotatable about an axis which extends in a direction which is generally transverse to a longitudinal axis of a barrel of the weapon; a processor assembly including a processor and an associated computer readable memory encoded with executable instructions, the processor configured, upon execution of the executable instructions, to receive input from the optical rangefinder representative of a distance to a target and calculate a trajectory angle of the weapon based on the distance to the target whereby the weapon will launch a projectile a distance that corresponds to the distance to the target; a motor mount disposed within the fixed section and including a projecting portion which extends into a complimentary cavity in the laser assembly, wherein the laser assembly is rotatable with respect to the motor mount, the motor mount including a downward extending leg, the downward extending leg including a spring which bears against a surface of said housing to provide an upward pivoting bias to the motor mount; a motor received within the motor mount and having a drive shaft coupled to the laser assembly, the motor configured to operate under the control of the processor assembly; and the processor configured, upon execution of the executable instructions, to operate the motor to rotate the laser assembly relative to the fixed section such that the barrel of the weapon will be aligned with the trajectory angle when an optical axis of the one or more lasers is aligned with the target; the optical rangefinder system comprising an optical emitter for sending an optical signal to the target, an optical detector for detecting the signal reflected from the target, and a second fastener for mounting the optical rangefinder system at a second location on the weapon.

* * * * *